US005215045A

United States Patent [19]

Vadnjal

[11] Patent Number: 5,215,045

[45] Date of Patent: Jun. 1, 1993

[54] CAM DRIVE INTERNAL COMBUSTION ENGINE

[76] Inventor: Ivan Vadnjal, M/V Tramarco Trader Strachan Shipping, 211 N. Conseption St., Mobil, Ala. 36630

[21] Appl. No.: 910,728

[22] Filed: Jul. 8, 1992

[51] Int. Cl.[5] ..... F02B 75/26; F02B 75/24

[52] U.S. Cl. ..... 123/58 A; 123/56 BC; 123/56 AC

[58] Field of Search ..... 123/58 A, 56 BC, 56 AC

[56] References Cited

U.S. PATENT DOCUMENTS

| | | | |
|---|---|---|---|
| 3,805,749 | 4/1974 | Karlan | 123/58 A |
| 4,090,478 | 5/1978 | Trimble et al. | 123/58 A |
| 4,465,042 | 8/1984 | Brutol | 123/58 A |
| 4,492,188 | 1/1985 | Palmer et al. | 123/58 A |
| 4,510,894 | 4/1985 | Williams | 123/58 A |
| 4,632,081 | 12/1986 | Giuliani et al. | 123/58 A |
| 4,934,344 | 6/1990 | Parr | 123/58 A |
| 4,974,555 | 12/1990 | Hooganboom | 123/58 A |
| 5,016,580 | 5/1991 | Gassman | 123/58 A |
| 5,060,603 | 10/1991 | Williams | 123/58 A |

*Primary Examiner*—Raymond A. Nelli
*Attorney, Agent, or Firm*—Leon Gilden

[57] ABSTRACT

An elongate cylindrical housing includes a housing axle coaxially thereof mounted medially of the housing axle, to include a cam member cylinder having a first and second cam drive surface to actuate first and second sets of pistons within respective first and second sets of cylinders. Openings through the housing are arranged to position a starter drive gear and a power take-off gear in operative communication with a cam drive gear mounted circumferentially about the cam.

2 Claims, 4 Drawing Sheets

CAM DRIVE INTERNAL COMBUSTION ENGINE

BACKGROUND OF THE INVENTION

1. Field of the Invention

The field of invention relates to internal combustion engines, and more particularly pertains to a new and improved cam drive internal combustion engine wherein the same effects a compact and vibrationally balanced engine arrangement.

2. Description of the Prior Art

With regard to vibration and necessary counterbalancing forces typically associated with a crank shaft, the instant invention attempts to address deficiencies of the prior art by utilizing a balanced engine assembly including a cam ring employing first and second cam surfaces to direct respective first and second sets of pistons into coaxially aligned cylinders of the first and second sets of pistons. Prior art cam drive internal combustion engines have been directed and exemplified by U.S. Pat. No. 4,834,033 to Larsen utilizing a drive shaft arranged parallel relative to opposed cylinders that are driven from a groove of a cylinder drive member.

Further examples of internal combustion engines and the like are set forth in U.S. Pat. Nos. 4,838,214; 4,825,820; and 4,813,524.

Accordingly, it may be appreciated that there continues to be a need for a new and improved cam drive internal combustion engine as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of internal combustion engine construction now present in the prior art, the present invention provides a cam drive internal combustion engine wherein the same is arranged to direct opposed cylinders on opposed sides of a central cam ring. As such, the general purpose of the present invention, which will be described subsequently in greater detail, is to provide a new and improved cam drive internal combustion engine which has all the advantages of the prior art internal combustion engine construction and none of the disadvantages.

To attain this, the present invention provides an elongate cylindrical housing including a housing axle coaxially thereof mounted medially of the housing axle, to include a cam member cylinder having a first and second cam drive surface to actuate first and second sets of pistons within respective first and second sets of cylinders. Openings through the housing are arranged to position a starter drive gear and a power take-off gear in operative communication with a cam drive gear mounted circumferentially about the cam.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cam drive internal combustion engine which has all the advantages of the prior art internal combustion engine construction and none of the disadvantages.

It is another object of the present invention to provide a new and improved cam drive internal combustion engine which may be easily and efficiently manufactured and marketed.

It is a further object of the present invention to provide a new and improved cam drive internal combustion engine which is of a durable and reliable construction.

An even further object of the present invention is to provide a new and improved cam drive internal combustion engine which is susceptible of a low cost of manufacture with regard to both materials and labor, and which accordingly is then susceptible of low prices of sale to the consuming public, thereby making such cam drive internal combustion engines economically available to the buying public.

Still yet another object of the present invention is to provide a new and improved cam drive internal combustion engine which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
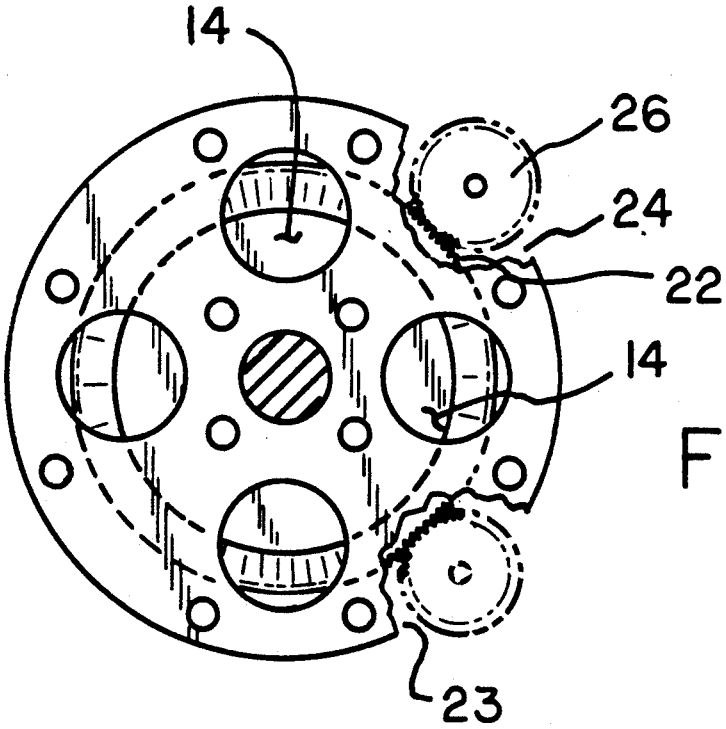
FIG. 1 is an orthographic top view indicating the orientation of the piston cylinders relative to the cam ring.
Figure 2:
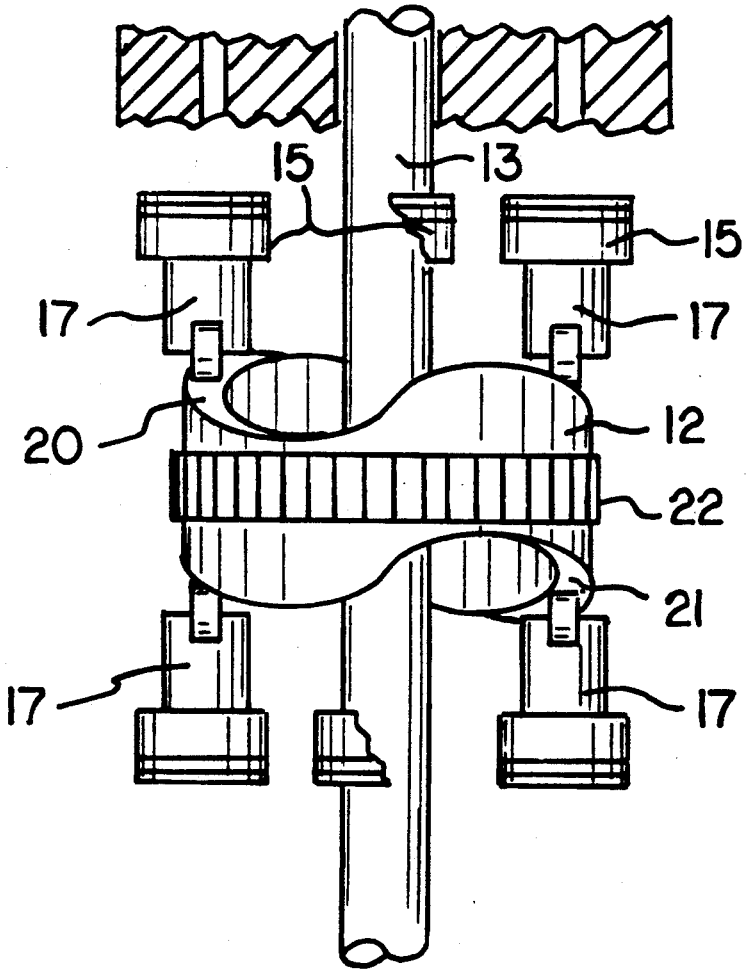
FIG. 2 is a diagrammatic illustration of the pistons arranged relative to the cam ring structure of the invention.
Figure 3:
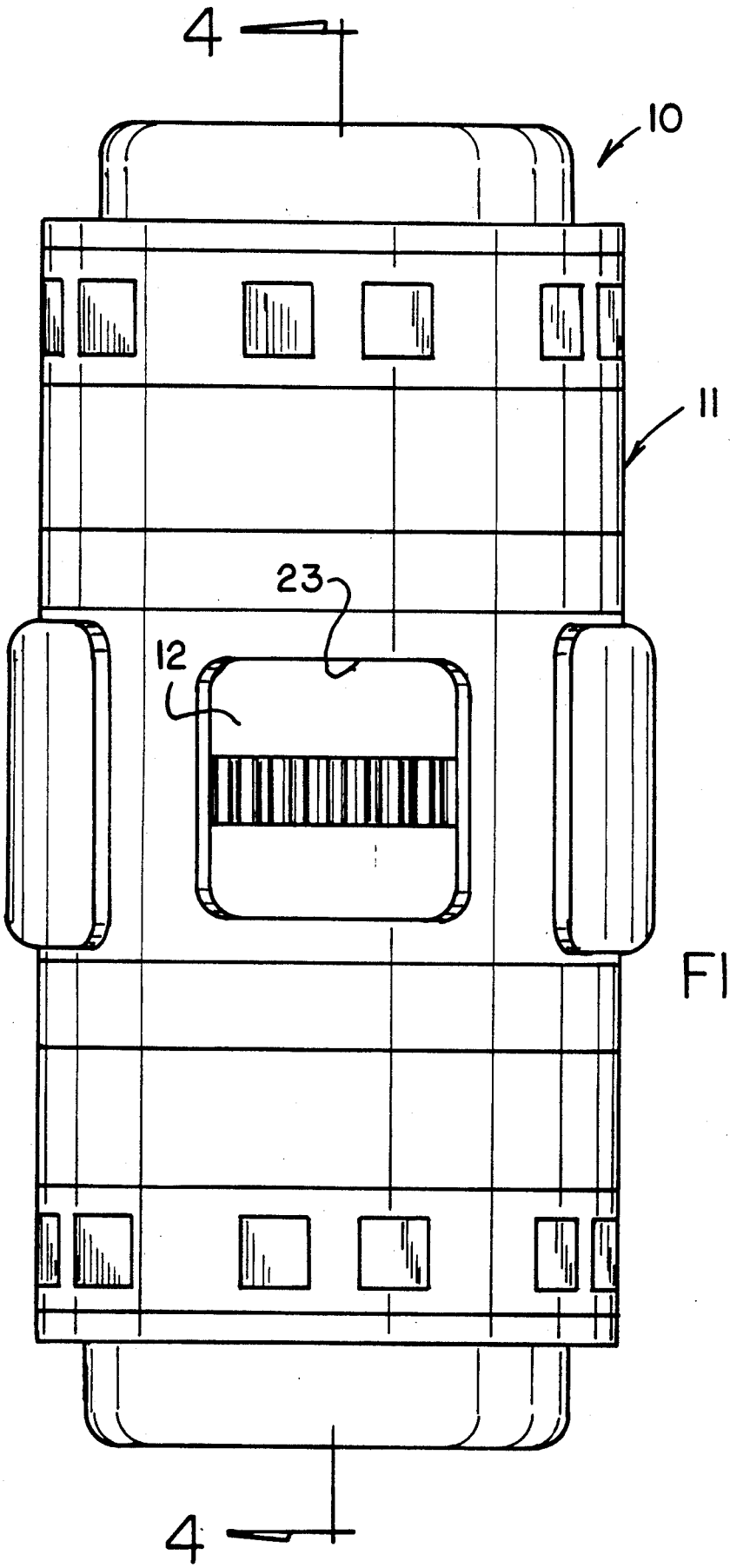
FIG. 3 is an orthographic view of the engine structure of the invention.
Figure 4:
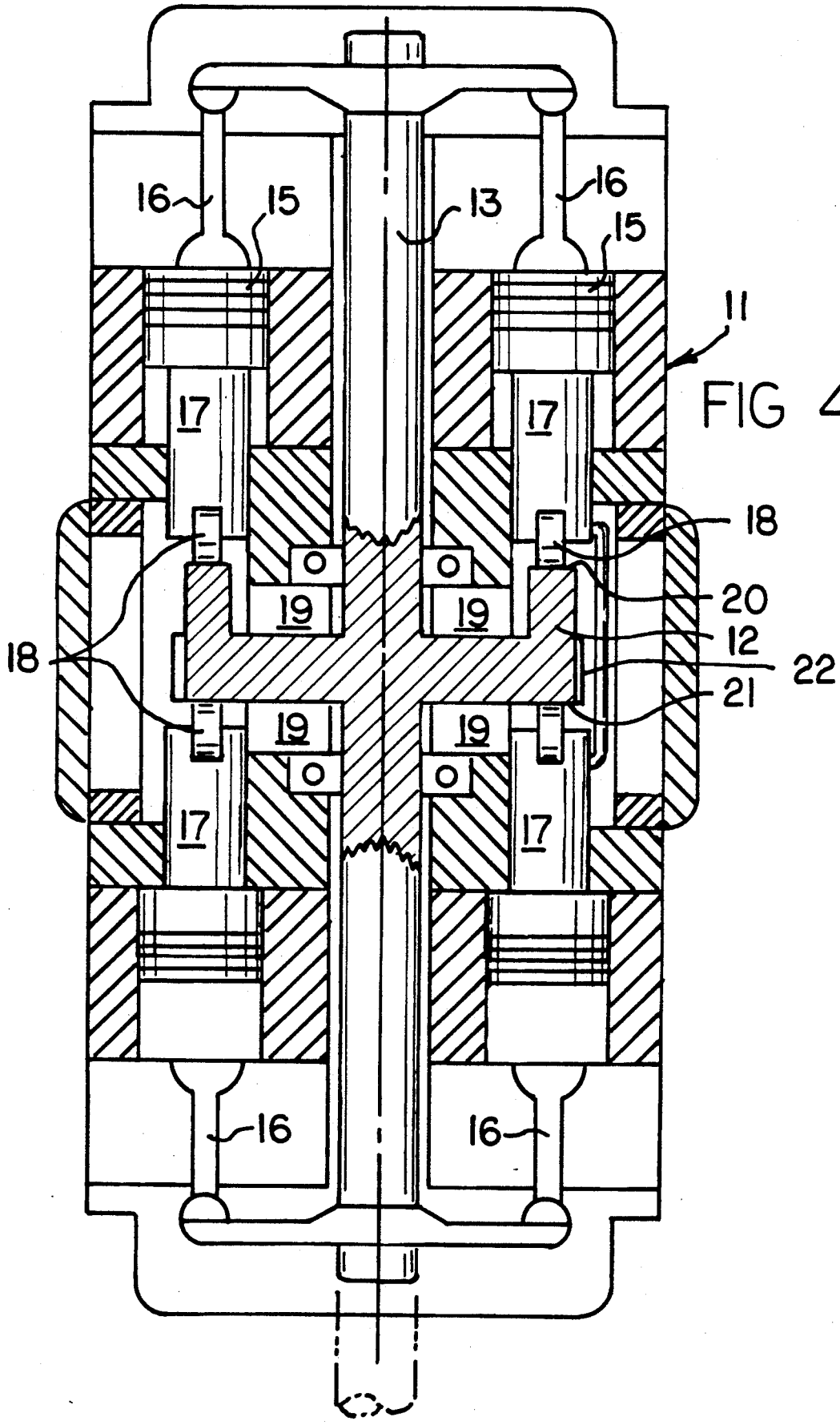
FIG. 4 is an orthographic view, taken along the lines 4—4 of FIG. 3 in the direction indicated by the arrows.
Figure 5:
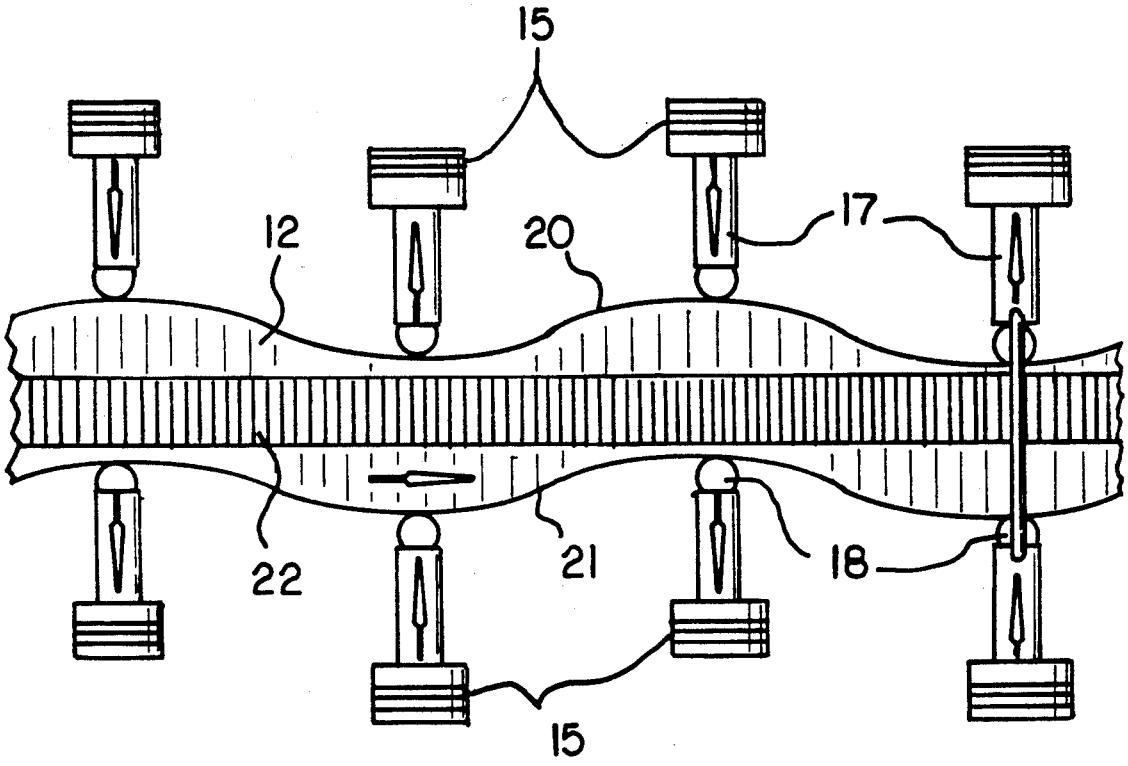
FIG. 5 is a diagrammatic illustration of the opposed piston rods in operative communication with the first and second surfaces of the cam ring.

With reference now to the drawings, and in particular to FIGS. 1 to 5 thereof, a new and improved cam drive internal combustion engine embodying the principles and concepts of the present invention and generally designated by the reference numeral 10 will be described.

More specifically, the cam drive internal combustion engine 10 of the instant invention includes a cylindrical crank housing 11 having a cam ring 12 rotatably mounted within the housing medially thereof rotatable about an axle 13 coaxially aligned relative to the housing 11. A predetermined number of cylinder bores 14 defining a first set are positioned on a first side of the cam ring 12 within the housing, and a second set of cylindrical bores are positioned on a second side of the cam ring within the housing, each in an annular array spaced an equal distance relative to one another, as indicated in FIG. 1 for example. Each piston cylinder of the first set on a first side of the cam ring 12 is coaxially aligned with a piston cylinder of the second set on a second side of the cam ring 12, in a manner as indicated in the FIGS. 2, 4, and 5. Each piston cylinder includes a piston member 15 reciprocatably mounted therewithin, including various cylinder ports 16 to direct intake and exhaust charges into each cylinder, in a manner as exemplified in U.S. Pat. No. 4,834,033 incorporated herein by reference.

Each piston member 15 includes a piston rod 17 fixedly mounted to each piston extending from the piston to the cam ring 12, with each piston rod 17 including a piston rod roller 18 mounted at a free end of each piston rod spaced from an associated piston member 15. The cam ring 12 includes a first cam surface 20 on a first side of the cam ring, and a second cam surface 21 on the second side of the cam ring to rotatably receive the piston rod rollers 18 of the first and second sets of pistons on the first and second sides of the cam ring 12. A gear ring 22 is circumferentially and fixedly mounted peripherally about the cam ring 12 medially thereof, with the housing 11 having a housing first and second window 23 and 24. The cam ring 22 is orthogonally oriented relative to the axle 13, as is the cam ring 12, and wherein the gear ring 22 is oriented in adjacency relative to the first and second windows 23 and 24. A starter motor gear 25 is in operative communication with the gear ring 22 through the first window 23, and a power take-off gear drive 26 is in operative communication with the gear ring 22 through the second window 24.

In this manner, bouncing of vibrational forces, as well as a compact unitary construction, is afforded in the orientation of the cam ring relative to the piston cylinder arrangements.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cam drive internal combustion engine, comprising, a cylindrical crank case housing, and an axle coaxially directed through the crank case housing, and a cam ring fixedly mounted to the axle medially of the axle in an orthogonal relationship relative thereto, and a predetermined number of first cylinder bores positioned in an equally spaced annular array on a first side of the cam ring, and second cylinder bores positioned on a second side of the cam ring within the crank case housing, with said second cylinder bores defining a number equal to the predetermined number, wherein each cylinder bore of said first set of cylinders bores is coaxially aligned with one of said cylinder bores of said second set of cylinder bores, and the first set of cylinder bores each include a first piston reciprocatably mounted therewithin, and the second set of cylinder bores include a second piston reciprocatably mounted therewithin, and the first set of pistons each include a first piston rod, and the second set of pistons each include a second piston rod, wherein the first piston rods and second piston rod are arranged parallel relative to the axle, and the first piston rods include rollers mounted thereon, and the second piston rods include second rollers mounted thereon, the cam ring including a first cam surface rotatably mounting the first rollers, and the cam ring further including a second cam surface mounting the second cam rollers rotatably thereon.

2. A combustion engine as set forth in claim 1 wherein the cam ring includes a gear ring circumferentially and peripherally mounted about the cam ring, with the gear ring orthogonally oriented relative to the axle, and the housing including a first window and a second window positioned over the cam ring, with a starter motor gear in operative communication with the gear ring through the first window, and a power take-off gear in operative communication with the gear ring through the second window.

* * * * *